United States Patent [19]

Nürk

[11] Patent Number: 4,984,436

[45] Date of Patent: Jan. 15, 1991

[54] THREAD EXCHANGE DEVICE, PARTICULARLY FOR KNITTING MACHINES

[75] Inventor: Siegfried Nürk, Albstadt-Pfeffingen, Fed. Rep. of Germany

[73] Assignee: SIPRA Patententwicklungs-und Beteiligungsgesellschfat mbH, Albstadt, Fed. Rep. of Germany

[21] Appl. No.: 249,588

[22] Filed: Sep. 26, 1988

[30] Foreign Application Priority Data

Oct. 7, 1987 [DE] Fed. Rep. of Germany ..... 3733796

[51] Int. Cl.[5] ..... D04B 15/62

[52] U.S. Cl. ..... 66/144; 289/3

[58] Field of Search ..... 66/144; 289/3

[56] References Cited

U.S. PATENT DOCUMENTS 4,123,014 10/1978 McCullough ..... 242/152.1
4,516,738 5/1985 Nürk ..... 242/152.1
4,691,535 9/1987 Cottenceau et al. ..... 66/144

FOREIGN PATENT DOCUMENTS 0063371 4/1982 European Pat. Off. .
3244887 6/1983 Fed. Rep. of Germany .

*Primary Examiner*—Wm. Carter Reynolds
*Attorney, Agent, or Firm*—Michael J. Striker

[57] ABSTRACT

A thread exchange device for multisystem knitting machines includes a knot unit for knotting a new thread on a movable old thread. The knot unit has a winding finger on which a closed loop of the new thread is formed, a part for moving the new thread into engagement with the winding finger, a loop turning lever that engages the old thread to form an open loop thereof and lays the open loop of the old thread into the closed loop of the new thread during continuous movement of the old thread. The knot unit further includes a hook that engages an end of the new thread and pulls the end of the new thread through the open loop of the old thread. The exchange device further includes a brake located between an element for establishing a thread compensation path and the knot unit for tightening a knot. The method relates to forming knots of a new thread with a movable old thread during continuous movement of the old thread with the use of the thread exchange device.

16 Claims, 9 Drawing Sheets

THREAD EXCHANGE DEVICE, PARTICULARLY FOR KNITTING MACHINES

BACKGROUND OF THE INVENTION

The present invention relates to a thread exchange device, for knitting machines, particularly for multisystem circular and flat knitting machines. More particularly it relates to such a thread exchange device which has a knot unit for knotting a new thread on an old thread during a thread exchange, with thread clamps and cutting elements for the new and old threads, wherein the knot unit includes a winding finger which engages a new thread and lies a close loop, a loop turning lever which introduces the old thread during the thread running as an open loop into the loop, and a clamping hook which extends through the loop and engages the end of the new thread.

Thread exchange devices of the above mentioned general type are known in the art. One such thread exchange device is proposed in the German document DE-OS 3,244,887 corresponding to U.S. Pat. No. 4,691,535. The present invention is a further improvement of the thread exchange device disclosed in this document.

SUMMARY OF THE INVENTION

Accordingly, it is an object of the present invention to provide a thread exchange device of the above mentioned general type, which increases the operational safety in the sense of the knot formation and the timely guidance of the thread further to a thread processing point.

In keeping with these objects and with others which will become apparent hereinafter, one feature of the present invention resides, briefly stated, in that the thread exchange device is provided behind the knot unit as considered in a thread pulling direction with a spring-biased turnable arm for establishing a thread compensation path of a fixed maximum length, and a compensator thread brake is provided before it and actuatable over a short time in dependence upon the position of the movable clamping hook and/or the loop turning lever, wherein the clamping hook is combined with a shear for cutting the new thread.

In the new thread exchange device, the formation of the knot on a running old thread as in the device disclosed in U.S. Pat. No. 4,691,535, is performed with the same advantages as compared with knot units in which a knot formation can be performed only on a stationary thread. The running old thread is held over a short time for fixing the formed thread knot. Thereby, an unobjectionable firm thread knot is obtained, which during its further movement to a thread processing point cannot be released by alternating pulling loads. The thread supply to the thread processing point is not interrupted since during the short actuation of the compensator thread brake, the threads are supplied 5 from the thread compensation path. The thread supply path is set by arresting of a compensator turning arm to an exactly fixed maximum length. By the fixed maximum length of the thread compensation path, the path over which the thread knot passes from the knot unit to the thread processing point is exactly established and can be evaluated as a fixed value in a control unit of the thread exchange device, which controls also the knot unit of the thread exchange device, in the sense of an exact placing of a formed knot in the knitted product. By the combination of the clamping hook with which the end of the new thread is engaged during the knot formation and through which a loop formed from the old thread passes, with a shear, it is achieved that an end loop of the new thread which is formed and anchored in the knots can be cut off and moreover the end of the new thread is cut off so that a special step of cutting the thread ends on a special cutting station can be dispensed with.

In the thread exchange device in accordance with the present invention, a thread drive which operates over a short time and is located in the thread pulling direction between the knot unit and the compensator brake can be provided. It can be formed for example as a blowing nozzle through which the thread passes. This thread drive provides the advantage that an unobjectionable knot formation can be guaranteed during slowly running machine and even immovable machine when no pulling from the machine working point is applied to the old thread. The thread drive produces the movement of the old thread provided for tightening of the formed knot, when on the other hand the clamping hook applies a pull to the new thread.

The desired increased operational safety of the thread exchange device and especially its knot unit can be increased by further features. The selectable thread can be supplied to the winding finger of the knot unit advantageously through a thread brake with a thread force which is changeable in dependence upon the position of at least one element of the knot unit. An electromagnetically operating thread brake is recommended, which can apply during interruption of the knot process either a predetermined braking force which tightly holds the thread loop of the new thread on the winding finger or provides a short complete blocking during the tightening of a formed knot.

The knot unit can be provided additionally with thread securing elements. They can include a forcing bracket which acts on the new thread and moves in direction toward the winding finger, and a thread guiding edge which moves along a portion of the movement path of the winding finger and is stationary. With these elements in the critical phase of the loop formation, the new thread is brought in the region of the winding finger, so that it is engaged with its end region by the winding finger and during the winding process is reliably held in the region of action of the winding finger.

A further critical point is a danger in each knot unit of remaining of the formed thread loop on the loop turning lever at the beginning of the knotting process. For eliminating this danger, the inventive device is provided with a thread securing element formed as a thread stripping part for engaging and stripping the thread loop from the winding finger during returned turning of the loop turning arm.

For increasing the operational safety, the control unit of the thread exchange device can be provided with sensors which determine at least the position of the loop turning lever and/or the clamping hook and/or the thread brakes. Advantageously, they also determine the position of the winding finger or the drive of the knot unit associated with these parts.

For increasing the operational safety of the thread exchange device in accordance with the present invention, a stationary control curve or cam can be provided. The clamping hook can be guided over the control curve, and the latter can act on a clamp of the clamping hook and its combined shear. Also, the loop exchange lever in its operational position can abut with its end provided with a thread guiding groove for the old thread, against an abutment which covers its thread guiding groove so as to form a closed thread through passage. Therefore the old thread which runs further to the thread processing point cannot spring out before the knot formation, and moreover, the loop which is formed of the new thread is prevented from sliding on the winding finger.

In accordance with the present invention, also a method of knot formation is proposed. More particularly, it is a method for knot formation in a thread exchange device by engaging a selected new thread by a winding finger, forming a closed loop of a new thread on the winding finger, inserting an open loop of an old thread in the loop of the new thread by means of a loop turning lever and passing a clamping hook through an open loop of the old thread, engaging an end of the new thread by the clamping hook and subsequently pulling the thread end through the loop of the old thread and moving back the loop turning lever which comprises the following steps:

(a) inwardly moving a forcing bracket to the winding finger during the formation of the thread loop;

(b) activating a thread brake for a new thread before finishing the formation of the thread loop;

(c) fixing the thread compensation paths in their maximum length before beginning of a knot formation;

(d) during the return movement of the turning lever and the clamping hook during the knot formation itself switching the thread break for the new thread during a part of the movement path to full braking and simultaneously activating over a short time a thread drive located between the knot unit and a compensator thread brake to thread running direction;

(e) in an end region of a return movement path of the clamping hook closing the compensator thread brake at least over a short time and substantially cutting the new thread by means of a shear combined with a clamping hook;

(f) after closing the compensator thread brake releasing a compensator turning arm of the thread compensation path.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
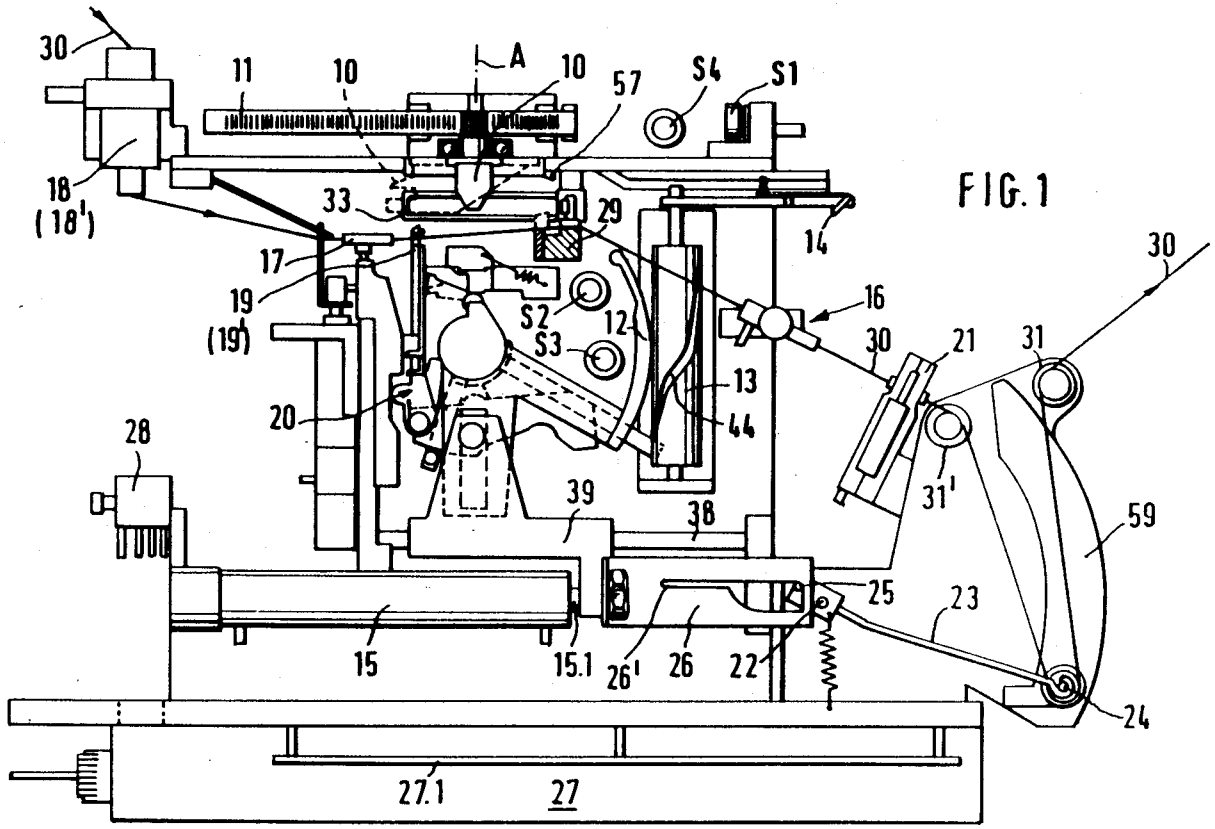
FIG. 1 is a side view of a thread exchange device in accordance with the present invention.

FIG. 1 shows a view of all parts of a thread exchange device with a removed protective hood. Only the parts which are germaine to the present invention are shown, and FIGS. 2, 3, 5, 6 show specific parts in more detail. An exact description of the drive of a winding finger 10, a loop turning lever 12 which cooperates with it, and a clamping hook 14 of a knot unit, as well as drive parts for selecting individual thread guides 17 of the thread exchange device and a thread clamping and a thread cutting unit 19 associated with each thread guide are dispensed with, since this drive and device parts are not the direct object of the invention and moreover disclosed in U.S. Pat. No. 4,691,535 or well known from not knotting thread ring apparatuses.

FIG. 1 shows a knot unit which has a winding finger 10 rotatable about an axis A between its initial position shown in solid lines and a position turned by 90° shown in broken lines. The unit further has a toothed rod 11 which serves for driving the winding finger 10, a loop turning lever 12, a central spiral groove cylinder 13 which couples the lever 12 in a driving manner with a clamping hook 14, a central drive cylinder 15 for the last mentioned parts, and a thread drive 16. Parts of the thread exchange device which are connected before the knot unit include a guide composed for example of four thread guides 17, and a thread brake which is arranged before it and formed as an electromagnetically actuated ball brake 18. A thread clamp 19 combined with a thread shear and provided with a drive mechanism 20 is associated with each thread guide and used for opening and closing. The parts which are arranged behind the knot unit as viewed in the running direction of a thread 30 include, in addition to the thread drive 16, a compensator-thread brake 21 and a compensator turning lever 23 which is turnable about a turning axis 22 and provided at its free end with a thread deviating roller 24. The turning lever 23 is positively coupled through a coupling pin 25 with a control plate 26 which has a guiding slot 26' and is movable by the main cylinder 15. The ball brake 18 and the compensation thread brake 21 may be designed as shown in U.S. Pat. No. 4,123,014 or 4,516,738 incorporated herein by reference thereto.

The control part of the thread exchange device shown in FIG. 1 includes a housing 27 for electronic control parts which are arranged on a conductor plate (printed circuit board) 27.1 and a pressure air regulating valve 28. FIG. 1 shows the thread exchange device in a normal operational position, or in other words at a time point $t_0$ in the time diagram of FIG. 4. In this position the thread 30 which is identified as an old thread later on, passes from a not shown thread storage through an associated and released ball brake 18, its thread guide 17 located in a normal initial position, a stationary centering part 29 which is joined for all thread of the knot unit, the inactive thread drive 16 formed as a blowing nozzle, and also the inactive compensator thread brake 21, and then runs through a first fixed thread roller 31', over the thread roller 24 of the compensator turning lever 23 located in its maximum turning position, and through a second fixed thread roller 31 to a thread processing point of a textile machine, especially a knitting machine. The running direction of the thread 30 is shown by arrows in FIGS. 1 and 7–11. Between the thread rollers 31 and 31' a thread reserve (thread compensation part) is formed, with a length which is determined by the respective position of the compensator turning lever 23 stabilized by a guiding path 59.

Figure 2:
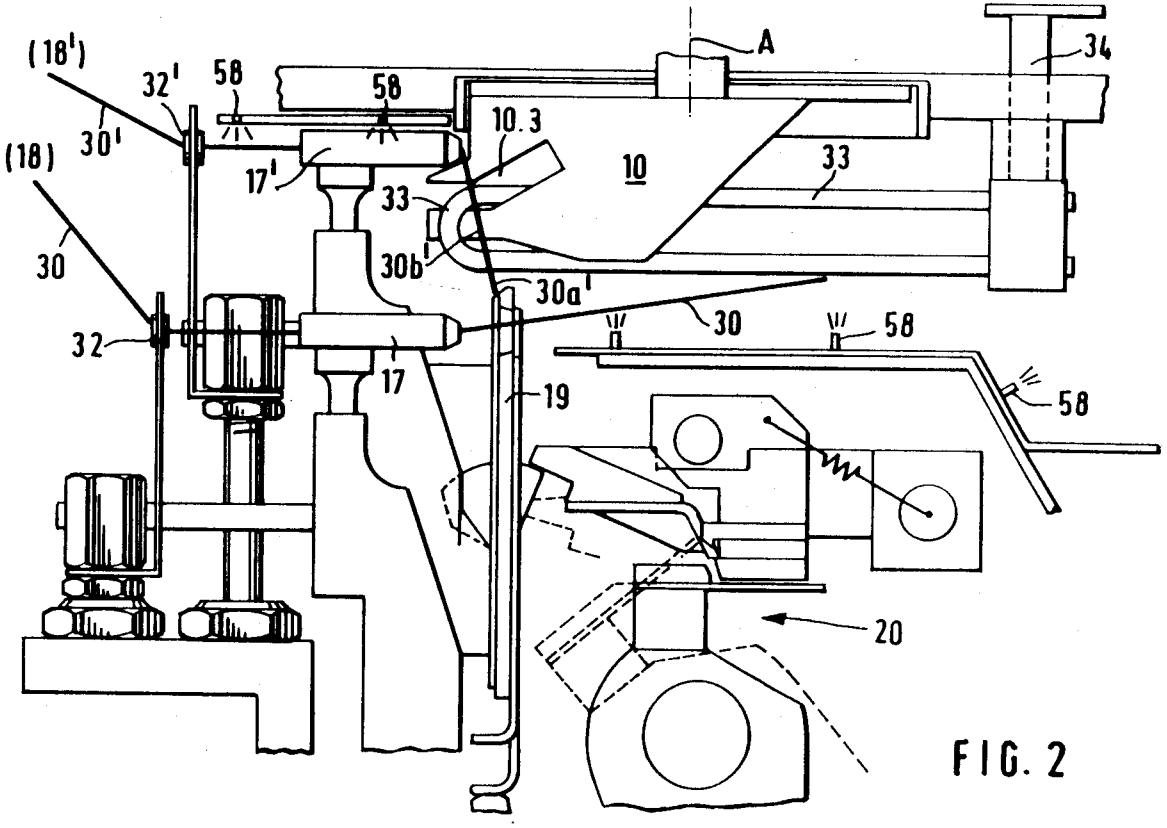
FIG. 2 is a partial side view of the thread exchange device of FIG. 1 on an enlarged scale.
Figure 4:
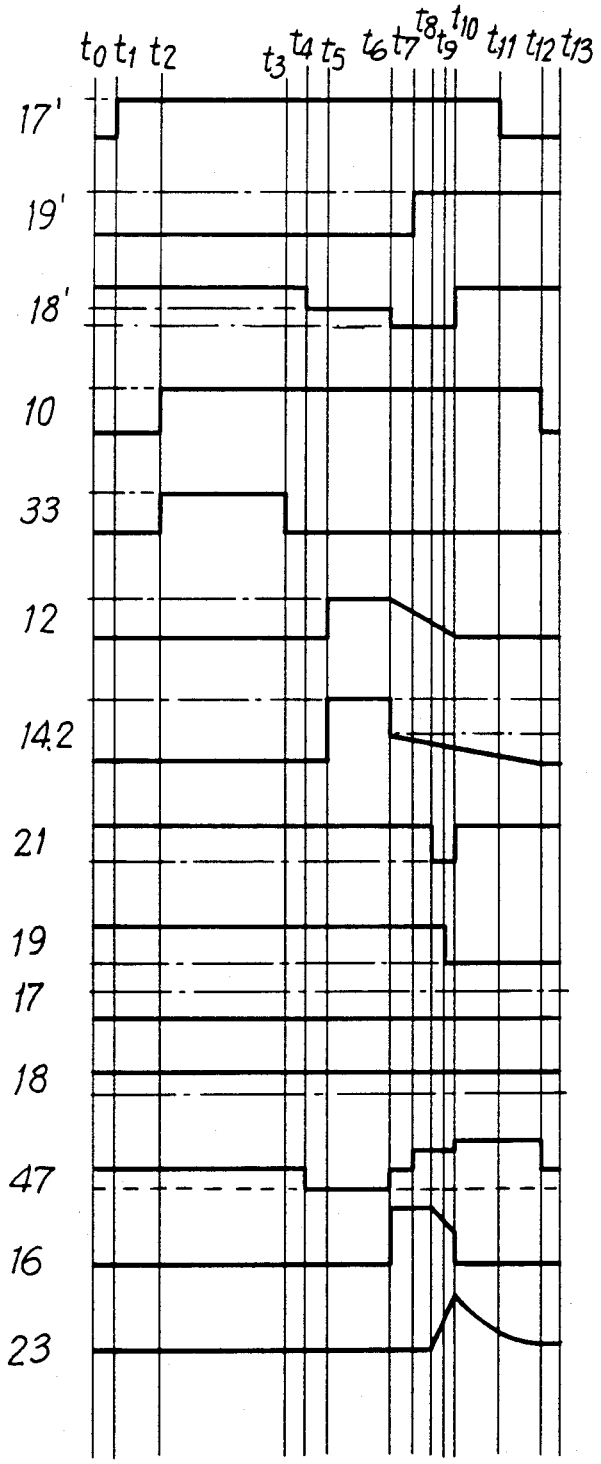
FIG. 4 is a time diagram of the operation of individual parts of the thread exchange device in accordance with the present invention.

FIG. 2 shows on an enlarged scale the region of the winding finger 10 of the thread exchange device after its preparation for a thread exchange, or in other words, in the time diagram of FIG. 4 between the time point $t_2$ and $t_3$. The old thread 30 runs further through a thread guiding ear 32 to its thread guide 17 which is located in a normal position, and then through the thread exchange device as described hereinabove. Another thread guide 17' of the four thread guides is displaced together with the connected thread guiding ears 32' from the normal position upwardly. The thread which is guided by it is called a new thread and identified with reference numeral 30'. It is held with its end 30a' in the associated thread clamp 19' which is combined with a shear. By lifting of the thread guide 17', an upwardly directed thread region 30b' is produced between the fixedly clamped thread end 30a' and the thread guide 17'. In this end region 30b', the new thread 30' is engaged by a forcing bracket 33 which is mounted on a turning shaft 34. The forcing bracket 33 engages the end portion 30b' of the new thread 30' as shown in FIG. 1 and displaces the same to the gripping region of the winding finger 10. The turning movement of the forcing bracket 33 about the turning axis 34 is provided in a not shown manner from a drive of the winding finger 10 and activated for example by means of two switching pins 61 and 62.

Figure 3:
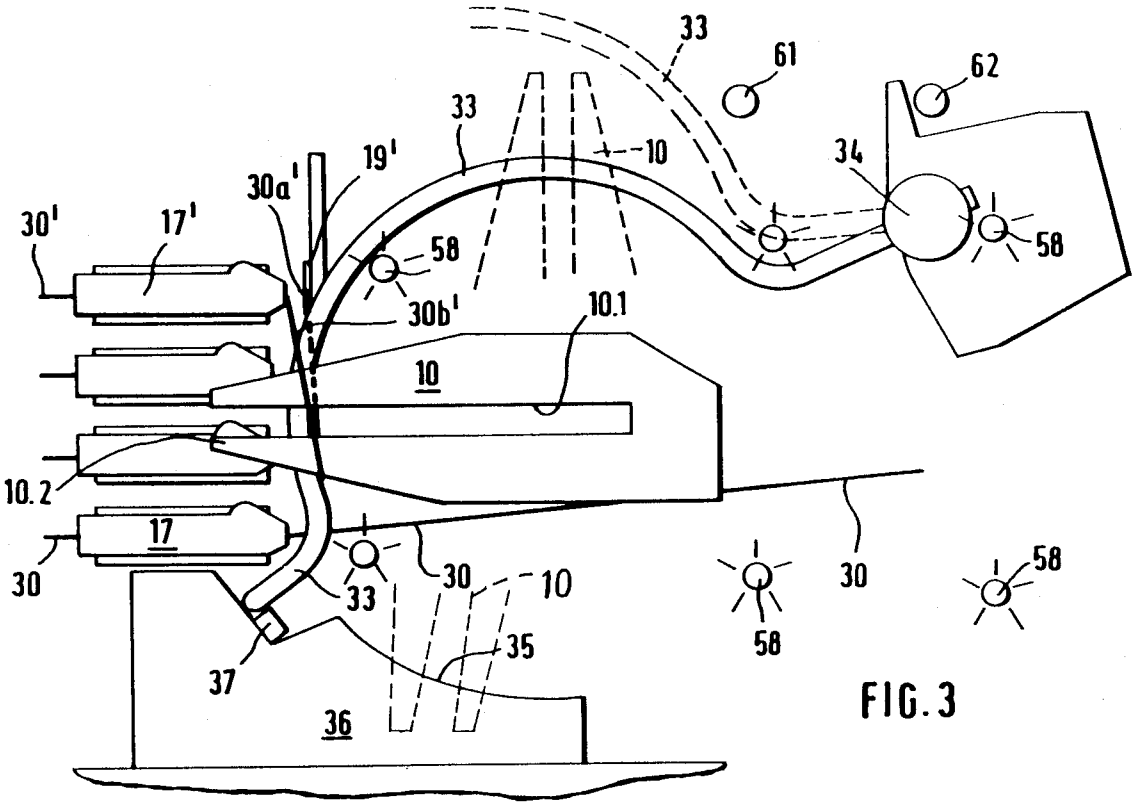
FIG. 3 is a plan view of a part of the thread exchange device of FIG. 2.

FIG. 3 shows an additional thread safety device which includes a thread guiding edge 35 extending along the movement path of the winding finger 10. The thread guiding edge 35 is formed on a stationary guiding plate 36 which also carries an elastic end abutment 37 for the forcing bracket 33, and performs a function similar to that of the forcing bracket 33. FIG. 2 also shows a drive mechanism for opening and closing of respective thread clamps 19 and 19' which is combined with a shear and identified as a whole with reference numeral 20. It will not be described in detail. This mechanism is driven at the beginning of the working stroke of the drive cylinder 15 which moves with its piston rod 15.1 a drive carriage 39 which is longitudinally movable on a guide rod 38 as shown in FIG. 1.

Figure 5:
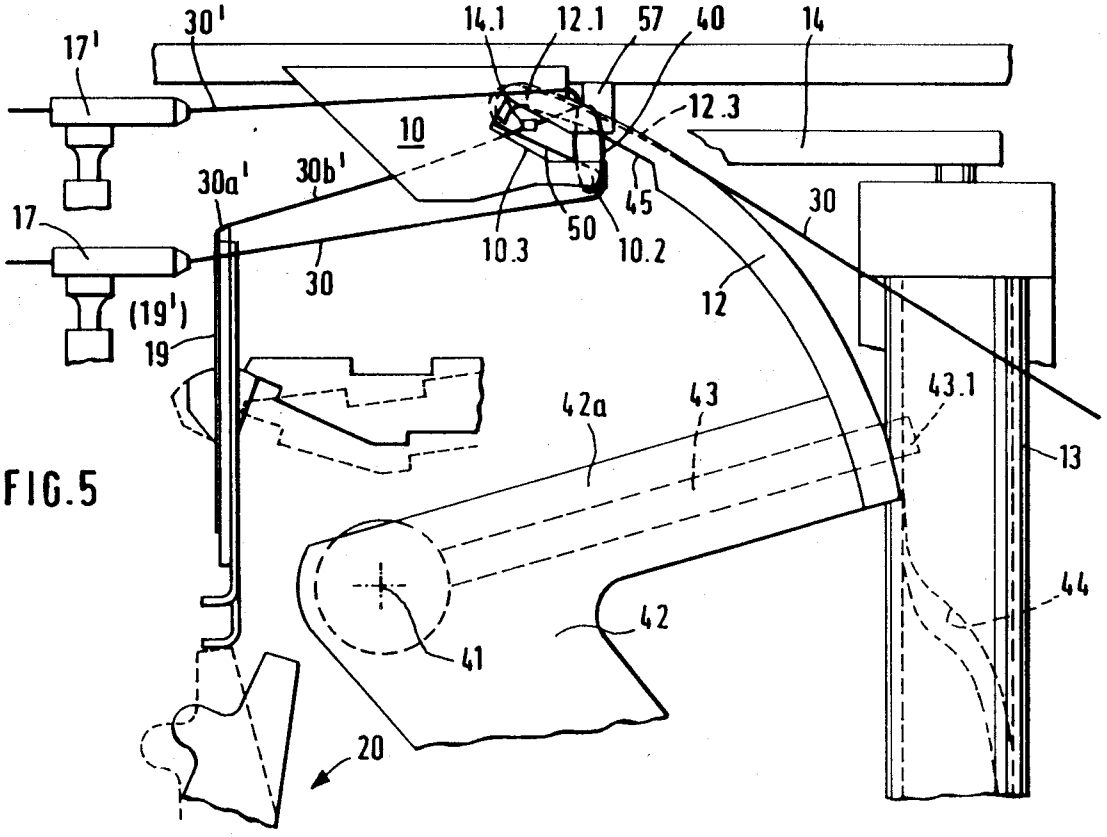
FIG. 5 is a partial side view of the thread exchange device with a loop turning lever, on an enlarged scale.

While the loop turning lever 12 is in FIG. 1 in its initial position, FIG. 5 shows the same in its operational position in which the loop turning lever 12 is inserted with its free end 12.1 into the slot 10.1 of the winding finger 10 shown in FIG. 3, and then on the winding finger 10 a closed thread loop 40 is formed from the new thread 30'. The knot unit assumes this position in the time point $t_5$ of the time diagram of FIG. 4. During the turning movement of the loop turning lever 12 about a turning axis 41 in a counterclockwise direction from the rest position of FIG. 1 to the operative position of FIG. 5, its free end 12.1 which is provided with a thread guiding groove 12.3 assumes the position near the centering part 29 of the running old thread 30 and moves the same during uninterrupted thread running to an open loop 50 through the closed loop 40 of the new thread 30' in the winding finger 10. In this position the free end 12.1 comes to abutment against an abutment 57, so that the thread guiding groove 12.3 of the loop turning lever 12 is closed for the running old thread 30 to a throughgoing passage which prevents a springing out of the thread from the thread guiding knot. The abutment 57 moreover secures the loop which is formed on the winding finger 10 against sliding off from the winding finger 10.

Figure 8:
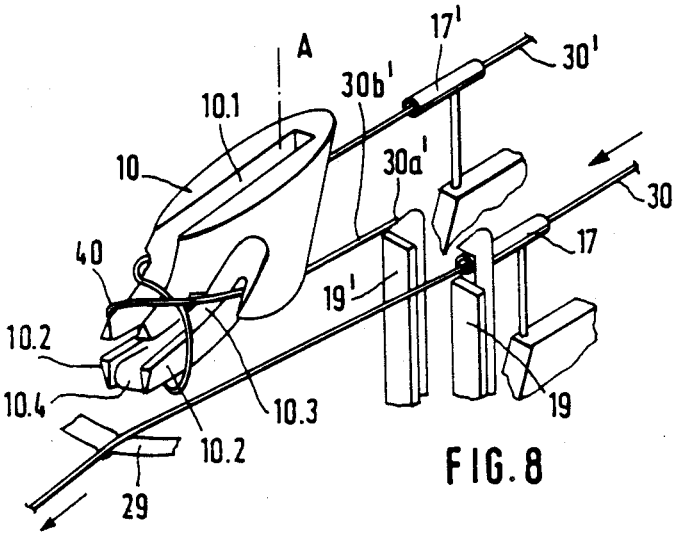

The loop turning lever 12 has the shape of a curved lance which is mounted on one arm 42a of a two-armed turning lever 42. The other arm of this lever which is not shown in FIG. 5 is coupled with the drive carriage 39 of the main drive cylinder 15. Parallel to the arm 42a and connected with it, a drive lever 43 is provided. The drive lever 43 engages with its free tip 43.1 into a spiral groove 44 of the tubular spiral groove cylinder 13 which rotates about its longitudinal axis and is shown in FIG. 1. During the turning movement of the loop turning lever 12 it actuates a rotary movement of the spiral groove cylinder 13. The clamping hook 14 is mounted on the upper end of the spiral groove cylinder 13 and shown in detail in FIG. 6. On its free end 12.1, the lance-shaped loop turning lever 12 is provided on its inner side with a round recess 45. In this end region the thread loop 50 formed from the running old thread 30 runs between the upper thread guiding groove 12.3 which is formed in the loop turning lever 12, and a thread guiding notch 10.4 formed in the lower projection 10.2 of the winding finger as shown in FIG. 8, with a distance from the lower edge of the loop turning lever 12.

Figure 6:
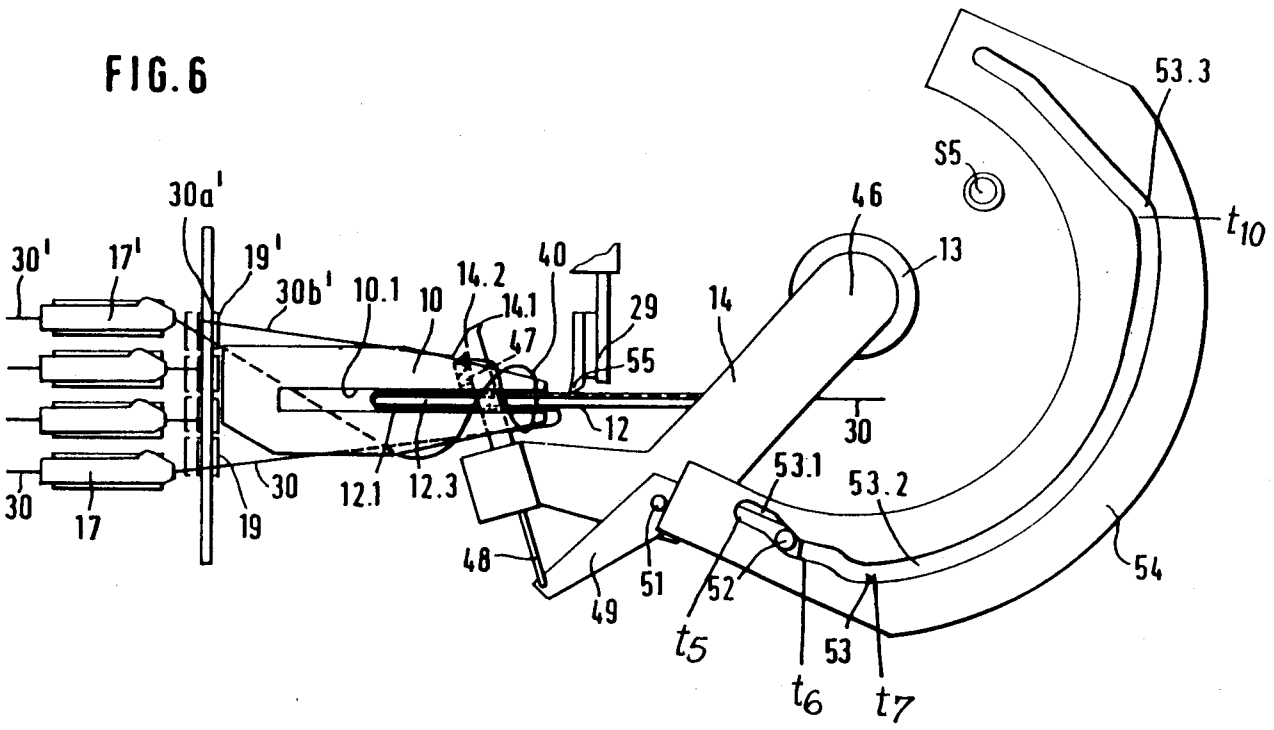
FIG. 6 is a plan view of a winding finger and a clamping hook of a knot unit of the invention device.
Figure 11:
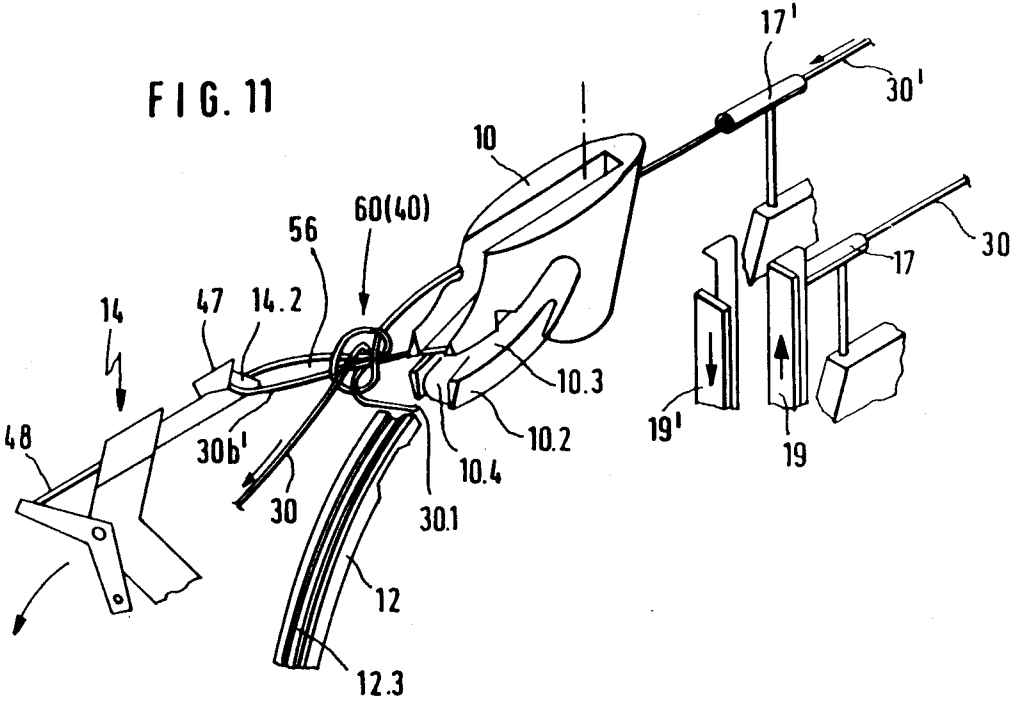

FIG. 6 shows in detail the clamping hook 14 which is turnable about a rotary axle 46 of the spiral groove cylinder 13 and coupled in a driving manner with the loop turning lever 12. The clamping hook 14 is formed as a turning lever as well. It is supported displaceable in a plane which extends perpendicularly to the turning plane of the loop turning lever 12 and is provided on its free end with a punching tip 14.1 and a hook 14.2. With these parts which are shown only schematically in FIG. 5, it extends in the position of the loop turning lever 12 shown in FIG. 5 through the transverse slot 10.3 of the winding finger 10 shown in FIGS. 2, 5, 8 and through the recess 45 of the free end 12.1 of the loop turning lever 12, and thereby also through a thread loop 0 formed from the running old thread. A movable clamping jaw 47 shown in FIGS. 6 and 11 is associated with the hook 14.2 and connected with a switching rod 48 which is connected with the end of one arm of a two-armed turning lever 49. The turning lever 49 is supported on the turnable clamping hook 14 displaceably about an axle 51 and carries at its other lever arm a control pin 52 which engages in a control groove 53 of the stationary control part 54.

The hook 14.2 on the free end of the clamping hook 14 engages the end portion of the new thread 30' which is wound on the winding finger 10 to the loop 40. As long as the control pin 52 is located in the end portion 53.1 of the control slot 53, the hook 14.2 is opened. When during the return turning movement of the clamping hook 14, the control pin 52 moves in the portion 53.2 of the control curve 53 as shown in FIG. 6, the clamping jaw 47 moves against, the hook 14.2 and fixes there the end portion 30b' of the new thread 30'. As long as the new thread is fixed on the hook 14.2, the thread end 30a' is released from the thread clamp 19', and during subsequent return movement of the clamping hook 14 in counterclockwise direction about its turning axle 46, the fixed end portion 30b' of the new thread 30' is pulled through the thread loop 50 formed by the old thread 30, as will be explained later on. At the end of the return movement of the clamping hook 14, when the control pin 52 moves in the end portion 53.3 of the control curve 53, the clamping jaw 47 which acts simultaneously as a shearing blade moves further against the hook 14.2 and thereby the new thread 30' is cut off at the clamping point.

FIGS. 5 and 6 show the knot unit between the time points $t_5$ and $t_6$ of the time diagram of FIG. 4 in a position in which the knot unit is prepared and from which the knot unit is released by a switching pulse supplied from the control part at the time point $t_6$. In the preparation position shown in FIGS. 5 and 6, the position of the individual knot elements is monitored by electrooptically or electromagnetically operating sensors S1–S4 (FIG. 1) and S5 (FIG. 6). When any of these sensors does not react, this means that the preparation position fails, and the release pulse for knot formation will not be given by the control part.

A sensor S1 is actuated by the toothed rod 11 when the winding finger 10 is in its end position for turning the loop turning lever 12 and the clamping hook 14. A sensor S2 which monitors the loop turning lever 12 determines this turning. A sensor S3 identifies the return movement of the turning lever 42 during the knot formation, for releasing the compensator thread brake 21. A sensor S4 influences the ball brakes 18 18.1 additional S5 which is shown in FIG. 6 and influenced by the clamping hook 14 lifts the whole braking of the ball brakes.

The operational sequence of the above described knot unit of the thread exchange device is illustrated by the time diagram of FIG. 4. The preparation of the knot and the knot formation itself in the region of the winding finger 10 is shown in detail in connection with FIGS. 7–9. In the time diagram of FIG. 4 the operational condition of several parts are identified by progress of the knot formation in the knot unit performed from the time point $t_0$ to the time point $t_{13}$. It includes the following parts of the device:

The thread guide 17' for the new thread 30', the thread clamp 19' for the new thread 30', the ball brake 18' for the new thread 30', the winding finger 10, the forcing bracket 13, the loop turning lever 12, the clamping hook 14, the compensator thread brake 21, the thread clamp 19 of the old thread 30, the thread guide 17 of the old thread and the ball brake 18 for the old thread 30.

In the time point $t_0$ the thread exchange device with its parts is located in the position shown in FIG. 1. The new thread guide 17' is located in its normal position which is identified in FIG. 4 with "out". The thread clamp 19' for the new thread 30' is closed and holds the thread end **30*a'*. The ball brake 18' for the new thread 30' is opened. The winding finger 10 is located in its initial position which in FIG. 4 is identified as "out". The same is for the forcing bracket 33, the loop turning lever 12 and the hook shear 14. The compensator thread brake 21 is opened, the thread guide 17 of the old thread is located in its normal position identified as "out", and the ball brake 18 for the old thread 30 is opened, so that the thread 30 passes through the thread exchange device unbraked for the path shown in FIG. 1**.

At the time point $t_1$ the preparation of the thread exchange device for a knot formation begins. The thread guide 17' is moved for the new thread 30' from the normal position upwardly as shown in FIG. 2.

Figure 7:
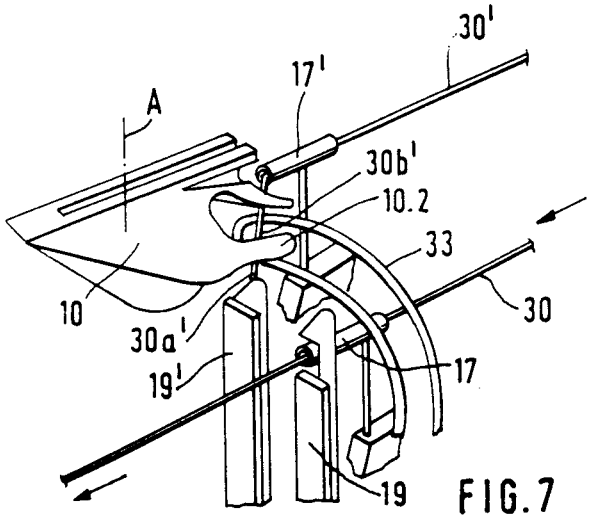
FIGS. 7–11 are perspective views of the winding finger and the associated parts of the knot unit at different stages of the knot formation.

At the time point $t_2$ the winding finger 10 is driven in rotation, as identified in the time diagram of FIG. 4 by the position "in". Simultaneously, the forcing bracket 33 is displaced in direction to the winding finger 10 and the new thread 30' lies with its end portion **30*b'* for the winding finger 10. During the subsequent formation of the loop 40 from the new thread 30' by the winding finger 10, both the forcing bracket 33 and the thread guiding edge 35 which is shown in FIG. 3 along the turning path of the winding finger guarantee the entrainment of the new thread 30' by the winding finger 10. FIGS. 3 and 7 show the position of the winding finger 10 which is rotatable about the axis A, and the cooperating forcing bracket 33** at the time point $t_2$.

In the time point $t_3$ the forcing bracket 33 returns to its initial position. At this time point the winding finger 10 performed approximately 1.5 revolutions and almost finishes the loop 40 from the new thread 30'. Shortly after this, at the time point $t_4$, the ball brake 18' through which the new thread 30' passes is partially activated so that a braking force is applied to the new thread 30'. This brake position is identified in the time diagram of FIG. 4 with "½". By the braking action of the ball brake 18' on the new thread 30', it is guaranteed that on the other hand the new thread 30' which is fixed with its end **30*a'* in the thread clamp 19' is pulled during the remaining quarter revolution of the winding finger 10 onto the winding finger, so that the loop 40 formed by it abuts in a proper position and tightly on the winding finger 10**.

Between the time point $t_4$ and $t_5$, the formation of the loop 40 from the new thread 30' is finished. The winding finger 10 remains in the position shown in FIG. 8. From the time diagram of FIG. 4 it is clear that first at the time point $t_{12}$ or in other words after finishing the knotting process, it turns back to its initial position shown in FIGS. 1 and 3. FIG. 8 illustrates the position of the loop 40 on the winding finger. FIG. 8 shows the thread guiding notch 10.4 and the transverse slot 10.3 of the winding finger 10, which are formed in the lower winding finger tip 10.2 In this position the new thread 30' is immovable, while the old thread 30 runs through the centering part 29 further to the thread processing point. The obtained position of the winding finger 10 is determined by the sensor S1 of the control part of the thread exchange device, and the sensor then allows the continuation of the knotting process.

Figure 9:
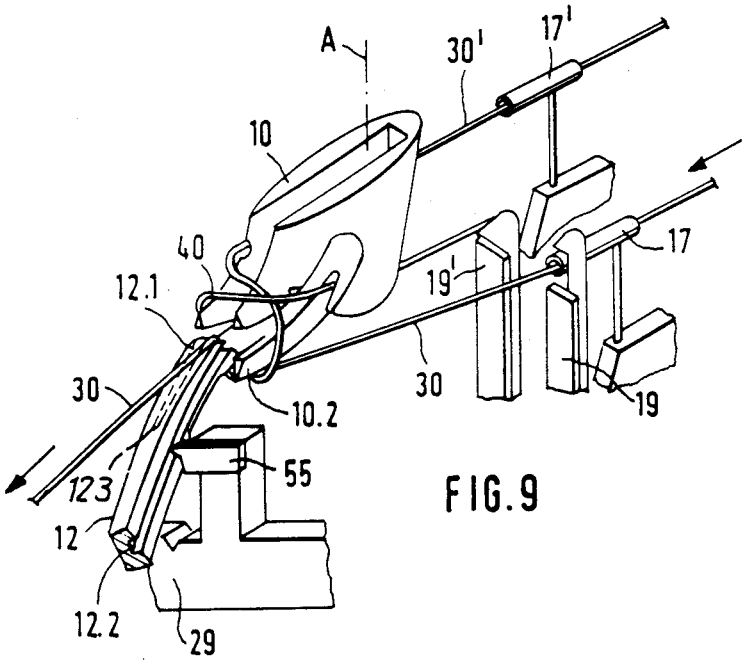

At the time point $t_5$, first the loop turning lever 12 is turned in the operational position shown in FIGS. 5 and 6 and immediately thereafter also the clamping hook 14 is turned with its hook 14.2 into the slot 10.1 or 10.3 of the winding finger 10. During turning, the loop turning lever 12 engages the old thread 30 shortly before the centering part 29 with its free end 12.1 and lays it during insertion of the free end 12.1 in the thread guiding notch 10.4 shown in FIG. 8, into the lower tip 10.2 of the winding finger. FIG. 9 shows this time of the insertion of the free end 12.1 of the loop turning lever 12. A loop stripping part 55 is shown in FIG. 9. It engages with its projection into a longitudinal groove 12.2 of the loop turning lever 12 and ensures that during later return turning of the loop turning lever 12 the loop 40 which is pulled from the winding finger 10 does not remain hanging on the loop turning lever 12. Between the time points $t_5$ and $t_6$ the compensator turning lever 23 is locked by insertion of the coupling pin 25 into the guiding slot 26' of the control plate 26, in its position which determines the maximum length of the compensation path. The thus obtained thread reverse can be given out between the time points $t_8$ and $t_{10}$.

Figure 10:
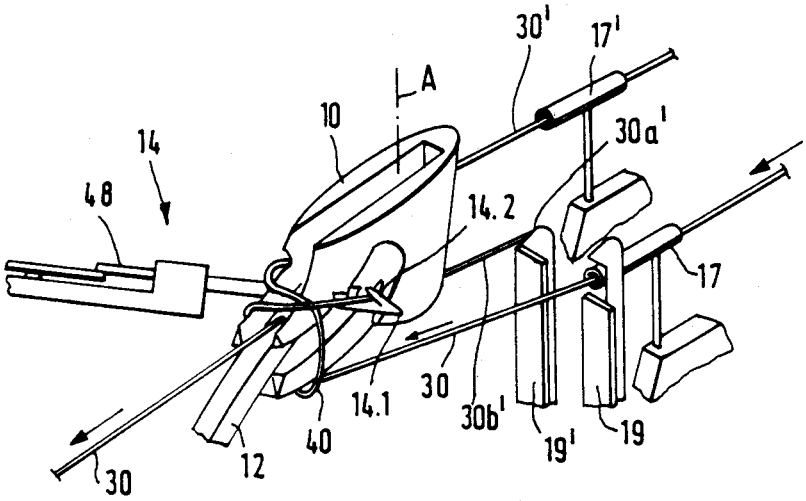

FIG. 10 shows the clamping hook 14 which is turned into the winding finger 10. The hook 14.2 in the region of recess 45 of the loop turning lever 12 shown in FIG. 5 passes the loop 50 of the old thread 30 shown in FIG. 5 which runs over the end 12.1 of the loop turning lever 12. It engages the end portion 30*b*′ of the stationary second thread 30′ which is fixed with its end 30*a*′ in the clamp 19′. During this, the first thread 30 runs further to the thread processing point. In this condition, in which a loop 50 which is formed by the old thread 30 lies in the formed loop 40 of the new thread 30′ and the clamping hook 14 engages the end region 30*b*′ of the new thread 30′, the knot unit is ready for the knotting process. Through the sensors S1, S2 and the control part of the thread exchange device, it is monitored whether the parts of the device assumed all positions which are prescribed for them and shown in FIG. 10. The subsequent knotting process is released at a calculated proper time point $t_6$ by a control signal supplied to the the drive of the knot unit.

In the time point $t_6$ in accordance with the time diagram of FIG. 4, the clamping hook 14 is brought in a position "clamping" which in accordance with FIG. 6 is achieved by turning back of the clamping hook 14 in counterclockwise direction in the control curve region 53.2, and the loop turning lever 12 is turned back again from the winding finger 10. The end portion 30*b*′ of the second thread 30′ is firmly clamped between the hook 14.2 and the clamping jaw 7 of the clamping hook 14. The ball brake 18′ for the new thread 30′ is switched to its full braking position, so that no new thread 30′ can pass through the thread guide 17′. The clamping hook 14 pulls the end portion 30*b*′ of the new thread 30′ through the loop 50 of the old thread 30 and through the loop 40 of the new thread 30′. During the return movement of the clamping hook 14 and the loop turning lever 12, the thread clamp 19′ at the time point $t_7$ opens, so that it releases the clamped end 30*a*′ of the new thread 30′. The return movement of the loop turning lever 12 and the clamping hook 14 is controlled by the main drive cylinder 15 shown in FIG. 1. During switching of the drive cylinder 15, the releasing pressure air is supplied into the blowing nozzle 16 through which the old thread 30 passes and which acts as a thread drive. The old thread 30 is driven in the thread running direction and thereby a fast and controlled return formation of the releasing thread loop 50 during retraction of the loop turning lever 12 from the winding finger 10 is achieved. Moreover, the old thread 30 is tightly retained by the achieved knot formation. Thereby there is no dependency of whether at this time point the old thread 30 runs with full speed or only with a low speed during slow running of the knitting machine, or at this moment the old thread 30 eventually stops. The blowing nozzle 16 operates openly over a short time and introduces a drive pulse which is attenuated tot he time points $t_8$ and $t_9$.

At the time point $t_8$ for a short time until the time point $t_{10}$ in accordance with the time diagram of FIG. 4, the compensator thread brake 21 is actuated and thereby the running of the old thread 30 is interrupted for a short time. The main drive cylinder 15 again releases at this point the coupling pin 25 in the control plate 26, so that despite the fixed compensation path formed with the compensator turning lever 23 with the deviating roller 24, the old thread 30 can be further supplied tot he thread processing point. The length of the thread 30 drawn by the lever 23 is the maximum length available to the needles during actuation of the compensator thread brake 21. At the time point $t_8$, the loop turning lever 12 goes back again, and the loop stripping part 55 shown in FIG. 9, is active. The clamping hook 14 pulls the end region 30*b*′ of the new thread 30′ which is pulled through the loop 50 and the loop 40 during its return movement in the operational region of the control curve 53 shown in FIG. 6. By the closed ball brake 18′, no new thread 30′ can be pulled after this, and the loop 40 is pulled down by the winding finger 10 and tightened during a short holding of the first thread 30 by the compensation thread brake 21 to knots 60. FIG. 1 shows the knot formation approximately at the time point $t_9$. At this time point the thread clamp 19 is closed for old thread 30, and the old thread 30 is cut off and its end is fixed in the clamp 19. The cut off end is shown in FIG. 11 and identified with reference numeral 30.1. The moved back clamping hook 14 tightens the knot 60. Out of the end portion 30*b*′ of the new thread 30′ a thread loop 56 is formed. It is cut in the control curve portion 53.3 shown in FIG. 6 by the clamping jaw 47 which is also a shearing jaw.

In the subsequent time point $t_{10}$, the clamping hook 14 reaches its end position and the loop 56 is cut off. The ball brake 18′ for the new thread 30′ is again fully opened, so that the new thread 30′ which is tied to the old thread 30 can be passed through in a free manner. The compensator thread brake 21 is again opened. Accordingly, the actuation time of the compensator thread brake 21 is between time points $t_8$ and $t_9$, and a braking force of the compensator brake 21 depends on respective positions of other knot unit parts during time span $t_8$–$t_{10}$ as schematically represented in FIG. 4. The knots 60 and the new thread 30′ behind it can again run to the thread processing point, in which the knots are shown exactly on a desired knitted product point.

At the time point $t_{11}$ the guide thread 17′ moves back to its initial position, or in other words, to the position which the thread guide 17 assumes for the old thread 30 in FIG. 9–11. Thereby the running new thread 30′ is moved completely out of the turning region of the winding finger 10 so that the winding finger subsequently at the time point $t_{12}$ can be moved back from its position shown in FIGS. 9–11 to its initial position shown in FIGS. 1 and 3. At the time point $t_{13}$ the knot unit is always in its initial position, from which a new knotting process can be started.

It will be understood that each of the elements described above, or two or more together, may also find a useful application in other types of constructions differing from the types described above.

While the invention has been illustrated and described as embodied in a thread exchange device especially for knitting machines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A thread exchange device especially for knitting machines, comprising a knot unit for knotting, during a thread exchange, a new thread on an old thread movable in a thread running direction, said knot unit including a winding finger for forming a closed loop of the new thread, means cooperating with said winding finger during forming of the closed loop, a loop turning lever for engaging the old thread, forming an open loop thereof and laying the open loop of the old thread into the closed loop of the new thread all during continuous movement of the old thread in the thread running direction, a hook movable to project through the open loop of the old thread for engaging an end of the new thread, means for pulling said hook to thereby pull the end of the new thread through the open loop of the old thread and for retracting said loop turning lever, means for clamping and thereafter releasing the new thread, and means for cutting the old thread and clamping an end thereof; means arranged behind said knot unit in the thread running direction for establishing a thread compensation path of a fixed maximum length; and a compensator thread brake located between said establishing means and said knot unit and actuatable for a short time for tightening a knot during formation of the knot.

2. A thread exchange device as defined in claim 1; and further comprising a thread drive which is located between said knot unit and said compensator thread brake and actuatable over a short time.

3. A thread exchange device as defined in claim 2, wherein said thread drive is formed as a blowing nozzle through which a thread passes.

4. A thread exchange device as defined in claim 1, and further comprising a thread brake arranged so that a new thread is supplied through said thread brake to said winding finger, said thread brake being formed so that its braking force is changeable in dependence on a position of at least one of parts of said knot unit.

5. A thread exchange device as defined in claim 4, wherein said thread brake is formed as an electromagnetically acutatable ball brake.

6. A thread exchange device as defined in claim 1, wherein said knot unit is additionally provided with mechanically actuated thread safety elements, said elements including a forcing bracket which is movable in a direction toward said winding finger to a new thread, and a stationary thread guiding edge which extends along a portion of said movement path of said winding finger.

7. A thread exchange device as defined in claim 1, wherein said loop turning lever has a longitudinal groove; and further comprising a stationary loop stripping part engaging in said longitudinal groove of said loop turning lever.

8. A thread exchange device as defined in claim 1; and further comprising a control including at least one sensor which cooperates with at least one of said loop turning lever and said hook.

9. A thread exchange device as defined in claim 1; and further comprising a control provided with sensors cooperating with said loop turning lever and said hook.

10. A thread exchange device as defined in claim 1; wherein said pulling and retracting means comprises a pneumatic drive cylinder which moves at least one of said winding finger, said loop turning lever and said clamping hook from their inoperative positive to their operative position and back; and a thread drive formed as a blowing nozzle through which a thread passes, said blowing nozzle being supplied with a pressure air during air discharge of said drive cylinder.

11. A thread exchange device as defined in claim 1, wherein said loop turning lever has a free end provided with a thread running groove for an old thread; and further comprising an abutment, said loop turning lever in its operational position abutting with its free end against said abutment which secures a loop on said winding finger against sliding off so that said thread running groove forms a closed thread passage.

12. A method of forming knots of a new thread with an old movable thread in an exchange device comprising a knot unit including a winding finger, a loop turning lever, and a hook; means arranged behind the knot unit for establishing compensation path; an old thread compensator brake located between the knot unit and the establishing means, said method comprising the steps:

moving the new thread into engagement with the winding finger and forming a closed loop of the new thread on the winding finger;

operating the loop turning lever to form an open loop of the old thread and to insert the open loop of the old thread into the closed loop of the new thread;

moving the hook from an initial position thereof through the open loop of the old thread to engage an end of the new thread;

locking a compensator turning arm of the establishing means to establish a thread compensation path;

returning the hook to the initial position thereof to pull the end of the new thread through the open loop of the old thread to thereby form a knot;

at an end stage of return movement of the hook, unlocking the compensator turning arm and closing the compensator thread brake over a short time to stop movement of the old thread at a location between the knot unit and the compensation path; and finishing the return movement of the hook to tighten the knot.

13. A method as defined in claim 12, further comprising the step of cutting the end of the new thread subsequent to tightening of the knot.

14. A method as defined in claim 12, wherein said moving and closed loop forming step includes moving a forcing bracket of the knot unit to the winding finger.

15. A method as defined in claim 12, comprising the step of actuating a brake of the new thread before finishing formation of the closed loop of the new thread.

16. A method as defined in claim 12, comprising the step of actuating for a short time a thread drive located between the knot unit and the establishing means to return the open loop of the old thread.

* * * * *